US010890176B2

(12) United States Patent
Fukuda

(10) Patent No.: US 10,890,176 B2
(45) Date of Patent: Jan. 12, 2021

(54) CONTROL DEVICE FOR HIGH PRESSURE PUMP

(71) Applicant: DENSO CORPORATION, Kariya (JP)

(72) Inventor: Hiroyuki Fukuda, Kariya (JP)

(73) Assignee: DENSO CORPORATION, Kariya (JP)

( * ) Notice: Subject to any disclaimer, the term of this patent is extended or adjusted under 35 U.S.C. 154(b) by 176 days.

(21) Appl. No.: 15/510,387

(22) PCT Filed: Sep. 1, 2015

(86) PCT No.: PCT/JP2015/004443

§ 371 (c)(1),
(2) Date: Mar. 10, 2017

(87) PCT Pub. No.: WO2016/042719

PCT Pub. Date: Mar. 24, 2016

(65) Prior Publication Data

US 2017/0284389 A1 Oct. 5, 2017

(30) Foreign Application Priority Data

Sep. 19, 2014 (JP) ..... 2014-191304

(51) Int. Cl.

| | |
|---|---|
| ***F04B 49/22*** | (2006.01) |
| ***F04B 19/22*** | (2006.01) |
| ***F04B 53/14*** | (2006.01) |
| ***F02D 41/20*** | (2006.01) |
| ***F02M 59/36*** | (2006.01) |
| ***F02M 59/46*** | (2006.01) |
| ***F02D 41/38*** | (2006.01) |

(Continued)

(52) U.S. Cl.

CPC ..... *F04B 49/22* (2013.01); *F02D 41/3845* (2013.01); *F04B 19/22* (2013.01);

(Continued)

(58) Field of Classification Search

None

See application file for complete search history.

(56) References Cited

U.S. PATENT DOCUMENTS 5,959,825 A * 9/1999 Harcombe ..... F02D 41/20 361/152
6,354,264 B1 * 3/2002 Iwakiri ..... F02D 35/023 123/305

(Continued)

FOREIGN PATENT DOCUMENTS

| | | |
|---|---|---|
| JP | 2014-145339 | 8/2014 |
| JP | 2015-014221 | 1/2015 |

*Primary Examiner* — Peter J Bertheaud
*Assistant Examiner* — Geoffrey S Lee
(74) *Attorney, Agent, or Firm* — Nixon & Vanderhye P.C.

(57) ABSTRACT

A control device includes a plurality of sound reducing parts that is operated individually, when a predetermined condition for operation is met, at each of a plurality of timings when an operating sound is generated as a result of a movement of a valve body, in one open-and-close period, and that reduces the operating sound, at each of the plurality of the timings, by changing a period of energizing an electromagnetic part to an increase side relative to a normal time, an upper limit determination part that determines whether a required period of energizing the electromagnetic part in the one open-and-close period exceeds a predetermined upper limit value, when all the plurality of the sound reducing parts are operated, and a selectively operating part that selects and operates one or more of the plurality of the sound reducing parts to an extent that the required period of energizing does not exceed the upper limit value, when the upper limit determination part has determined that the required period of energizing exceeds the upper limit value.

29 Claims, 6 Drawing Sheets

(51) Int. Cl.
*F04B 53/00* (2006.01)
*F04B 53/16* (2006.01)
*F02M 59/02* (2006.01)

(52) U.S. Cl.
CPC ..... *F04B 53/001* (2013.01); *F04B 53/14* (2013.01); *F04B 53/16* (2013.01); *F02D 2041/2027* (2013.01); *F02D 2041/2037* (2013.01); *F02D 2041/2048* (2013.01); *F02D 2041/2058* (2013.01); *F02D 2200/0602* (2013.01); *F02M 59/025* (2013.01); *F02M 59/366* (2013.01); *F02M 59/368* (2013.01); *F02M 59/466* (2013.01)

(56) References Cited

U.S. PATENT DOCUMENTS 6,425,367 B1 * 7/2002 Hiraya ..... F02B 1/12 123/299
7,552,720 B2 * 6/2009 Borg ..... F02M 59/366 123/506
7,856,964 B2 * 12/2010 Sykes ..... F02D 41/2096 123/490
9,341,181 B2 * 5/2016 Sakamoto ..... F04B 49/22
2001/0052335 A1 * 12/2001 Miyakubo ..... F02B 1/04 123/305
2004/0168674 A1 * 9/2004 Djordjevic ..... F02D 41/3082 123/456
2007/0290573 A1 * 12/2007 Sykes ..... F02D 41/2096 310/311
2013/0032212 A1 * 2/2013 Tokuo ..... F02D 41/20 137/1
2013/0243608 A1 * 9/2013 Sakamoto ..... F04B 49/22 417/26
2014/0099215 A1 * 4/2014 Kawano ..... F02M 59/368 417/279
2014/0158205 A1 * 6/2014 Tanabe ..... F02D 41/3845 137/1
2016/0186741 A1 * 6/2016 Sakamoto ..... F02M 63/0049 417/290
2017/0211558 A1 * 7/2017 Zhang ..... F02D 41/3082

* cited by examiner (a)

FIG. 7

| | FIRST SOUND REDUCING PART (PWM DRIVE) | SECOND SOUND REDUCING PART (DUTY OF STOPPING ENERGIZING) | THIRD SOUND REDUCING PART (REENERGIZING) |
|---|---|---|---|
| SOUND REDUCING EFFECT | LARGE | SMALL | LARGE |
| ENERGIZING PERIOD (TIME REDUCING EFFECT) | LONG (LARGE) | LONG (LARGE) | SHORT (SMALL) |
| STOP-PRIORITY ORDER | 2 | 1 | 3 |

CONTROL DEVICE FOR HIGH PRESSURE PUMP

CROSS REFERENCE TO RELATED APPLICATION

This application is the U.S. national phase of International Application No. PCT/JP2015/004443 filed 1 Sep. 2015, which designated the U.S. and claims priority to JP Patent Application No. 2014-191304 filed 19 Sep. 2014, the entire contents of each of which are hereby incorporated by reference.

TECHNICAL FIELD

The present disclosure relates to a control device for a high pressure pump.

BACKGROUND ART

Conventionally, as a fuel supply system of an internal-combustion engine such as a gasoline engine and a diesel engine, a cylinder injection type fuel supply system has been known. The fuel supply system includes a high pressure pump that increases the pressure of low pressure fuel having been pumped up from a fuel tank to a high value, and a pressure accumulating pipe that stores high pressure fuel having been pressure-fed from the high pressure pump. In the fuel supply system, the high pressure fuel having been stored in the pressure accumulating pipe is directly injected by means of a fuel injection valve into a cylinder of the internal-combustion engine. A known type of the above-mentioned high pressure pump includes a plunger that reciprocates in the cylinder, a pressurization chamber into which the fuel is introduced from the low pressure side, and an electromagnetically driven regulating valve that controls the fuel discharge amount of the high pressure pump by adjusting the returning amount of the fuel introduced into the pressurization chamber.

For example, in the above-mentioned high pressure pump, the plunger is connected to a rotating shaft of an output shaft (a crankshaft) of the internal-combustion engine. Thereby the plunger reciprocates in the cylinder when the rotating shaft rotates as a result of the rotation of the crankshaft, so that the capacity of the pressurization chamber is variable. Examples of the regulating valve include an electromagnetic valve that is of a normally-open-type. In such a regulating valve, when a solenoid coil is not energized, a valve body is maintained in a valve-opening position by means of a spring. This allows the fuel to be introduced from a low pressure side passage into the pressurization chamber. When the coil is energized, the valve body is shifted to a valve-closing position by electromagnetic attraction force of the coil. This prevents the fuel from being introduced into the pressurization chamber. In a stroke where the capacity of the pressurization chamber is decreasing, when the valve body is in the valve-opening position, surplus fuel is returned from the pressurization chamber to the low pressure side as the plunger moves. After that, the valve body is shifted to the valve-closing position by energizing the coil, then the fuel in the pressurization chamber is pressurized by the plunger, and is discharged to a high pressure side. In this manner, the displacement of the high pressure pump is controlled.

At the time of the operation of the regulating valve, a vibration is produced when the valve body hits a movement limiting member (a stopper part). The vibration causes an operating sound that may make an occupant of a vehicle feel uncomfortable. In Patent Literature 1, there is a description of a technique for reducing the operating sound resulting from the opening and closing movements of the regulating valve in discharge amount control of the high pressure pump by the regulating valve.

The high pressure pump described in Patent Literature 1 has a configuration in which the valve body of the regulating valve is moved, so that the regulating valve can open and close, by means of an electromagnetic actuator including a movable part and a solenoid. Further, it is disclosed in Patent Literature 1, as a technique for controlling the opening of the valve for reducing the operating sound, that the movable part is maintained in the valve-closing position by continuously energizing the solenoid until the valve body starts to move in the valve-opening direction as a result of reduction in the fuel pressure in the pressurization chamber. In addition, it is also disclosed that the operating sound produced when the valve body hits a stopper part is reduced by temporarily energizing the solenoid before the movable part reaches a valve-opening position so that the movement speed of the movable part is decreased (in other words, the energizing period is extended).

PRIOR ART LITERATURES

Patent Literature

Patent Literature 1: JP2014-145339A

SUMMARY OF INVENTION

Operating sounds resulting from opening and closing of the regulating valve are produced at a plurality of timings during a single "open-and-close" period. The open-and-close period means each of a series of movements in which the regulating valve opens and closes. In terms of reducing the sound, it is effective to energize the coil in order to reduce the sound at each of the plurality of the timings when the operating sound is produced. On the other hand, when the coil is energized in order to reduce the sound at all of the plurality of the timings when the operating sound is produced, a coil-energizing period in one open-and-close period of the regulating valve is extended. As a result, sound reducing control may be limited by, for example, an upper limit guard for the coil-energizing period, which is determined in terms of hardware protection. To prevent the coil-energizing period in one open-and-close period of the regulating valve from exceeding an upper limit value, it may be desirable that driving of the high pressure pump be back to a normal control. However, when driving of the high pressure pump is back to the normal control, the operating sound increases, which may make a driver feel uncomfortable.

The present disclosure is given to solve the above-described problem. An object of the present disclosure is to provide a control device for a high pressure pump, which is capable of reducing effectively an operating sound made by the high pressure pump, while satisfying the limitations on a period of energizing an electromagnetic part.

According to an aspect of the present disclosure, the control device is applied to the high pressure pump including a plunger that reciprocates with rotation of a rotating shaft so that a capacity of a pressurization chamber is variable, and a regulating valve having a valve body placed in a fuel suction passage communicating with the pressurization chamber, the regulating valve supplying fuel to the pressurization chamber and shutting off fuel supply to the pressurization chamber, as a result of moving the valve body by switching an electromagnetic part between an energized state and a non-energized state, and that adjusts a fuel discharge amount of the high pressure pump by switching the regulating valve between an open state and a closed state.

The control device includes a plurality of sound reducing parts that is operated individually, when a predetermined condition for operation is met, at each of a plurality of timings when an operating sound is generated as a result of a movement of the valve body, in one open-and-close period in which the valve body makes an opening movement and a closing movement, and that reduces the operating sound, at each of the plurality of the timings, by changing a period of energizing the electromagnetic part to an increase side relative to a normal time, an upper limit determination part that determines whether a required period of energizing the electromagnetic part in the one open-and-close period exceeds a predetermined upper limit value, when all the plurality of the sound reducing parts are operated and a selectively operating part that selects and operates one or more of the plurality of the sound reducing parts to an extent that the required period of energizing does not exceed the upper limit value, when the upper limit determination part has determined that the required period of energizing exceeds the upper limit value.

In the high pressure pump, when the sound reducing control is performed to reduce the operating sound of the regulating valve, the coil-energizing period in one open-and-close period of the valve body is extended. As a result, the sound reducing control may be limited by, for example, an upper limit value that is determined in terms of hardware protection. On this point, with the configuration described previously, the sound reducing control is performed positively on one or more of the plurality of the sound reducing parts, instead of canceling the sound reducing control entirely. As a result, the operating sound caused by opening and closing the valve body is reduced as much as possible, within the limitations on the coil-energizing period in one open-and-close period of the valve body.

BRIEF DESCRIPTION OF DRAWINGS

The above and other objects, features and advantages of the present disclosure will become more apparent from the following detailed description made with reference to the accompanying drawings. In the drawings:

FIG. 7 is a diagram showing a map of stop-priority order.

DESCRIPTION OF EMBODIMENTS

Figure 1:
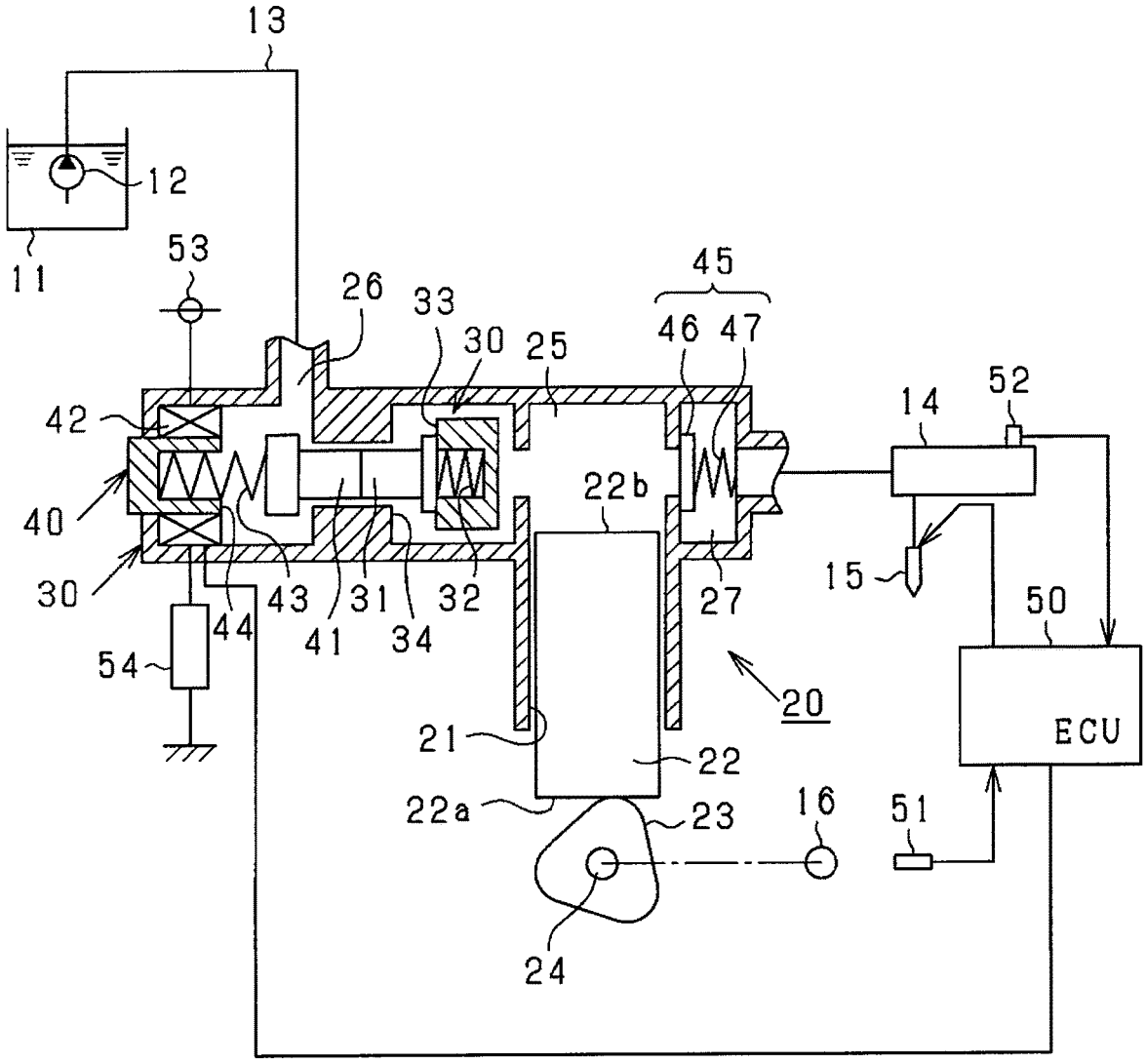
FIG. 1 is a configuration diagram showing an overall outline of a fuel supply system of an engine.

Specific embodiments of the present disclosure are described below, with reference to the drawings. The present embodiment forms a fuel supply system that supplies fuel to a cylinder injection type in-vehicle gasoline engine that is an internal-combustion engine. The system, with an electronic control unit (an ECU) as its core, controls the fuel discharge amount of a high pressure pump, and the fuel injection amount of an injector. FIG. 1 is a configuration diagram showing the overall outline of the system.

The fuel supply system shown in FIG. 1 includes a fuel tank 11 that stores the fuel, and a low pressure pump 12 that is of an electromagnetic-drive type. The low pressure pump 12 pumps up the fuel stored in the fuel tank 11, and supplies the fuel to a high pressure pump 20 via a low pressure pipe 13. The high pressure pump 20 increases the pressure of the fuel to a high value so as to pressure-feed the fuel to a pressure accumulating pipe 14. The high pressure fuel having been pressure-fed to the pressure accumulating pipe 14 is stored in the pressure accumulating pipe 14 in a high pressure state. The high pressure fuel is then injected directly into a cylinder of the engine, from an injector 15 attached to each cylinder. The pressure accumulating pipe 14 has a fuel pressure sensor 52 that detects the fuel pressure. The fuel pressure sensor 52 detects the fuel pressure in the pressure accumulating pipe 14.

The following is a description of the high pressure pump 20. The high pressure pump 20 in the present system is formed as a plunger pump. The fuel is sucked and discharged as a result of the movement of a plunger.

Specifically, as shown in FIG. 1, in the high pressure pump 20, a pump body has a cylinder 21. The plunger 22 is inserted in the cylinder 21 in such a way that the plunger reciprocates in the axis direction. A first end 22*a* of a plunger 22 is in contact with a cam 23 with urging force of a spring that is not shown. The cam 23 has a plurality of cam lobes. The cam 23 is fixed to a camshaft 24 functioning as a rotating shaft that rotates with the rotation of a crankshaft 16 that is an output shaft of the engine. When the engine operates, the crankshaft 16 rotates, causing the cam 23 to rotate, and accordingly, the plunger 22 moves in the cylinder 21 in the axis direction.

There is a pressurization chamber 25 at a second end 22*b* of the plunger 22. The pressurization chamber 25 communicates with each of a fuel suction passage 26 and a fuel exhaust passage 27. The fuel is introduced into and exhausted from the pressurization chamber 25, via the passages 26 and 27, respectively.

A regulating valve 30 is placed in the fuel suction passage 26. The regulating valve 30 supplies the fuel to the pressurization chamber 25, and also shuts off the fuel supply to the pressurization chamber. The regulating valve 30 includes a valve body 31 placed in the fuel suction passage 26, and an electromagnetic actuator 40 that causes the valve body 31 to move to open and close the valve. The regulating valve 30 is configured as a switching valve that allows and shuts off the flow of the fuel in the fuel suction passage 26 by shifting the valve body 31 as a first valve body.

The electromagnetic actuator 40 is placed in the fuel suction passage 26. The electromagnetic actuator 40 includes a movable part 41 that can move in the same direction as the opening and closing direction of the valve body 31, and a coil 42 that functions as an electromagnetic part to move the movable part 41. When the coil 42 is not energized, the movable part 41, as a second valve body, is maintained in a valve-opening position by means of a spring 43 that is an urging part. When the coil 42 is energized, the movable part 41 resists the urging force of the spring 43, and shifts to a valve-closing position in which the movable part 41 is in contact with a stopper part 44. The stopper part 44 is a movement limiting member that limits the movement of the movable part 41. A power supply 53 is connected to the input terminal side of the coil 42, so that power is supplied from the power supply 53 to the coil 42.

Figure 2:
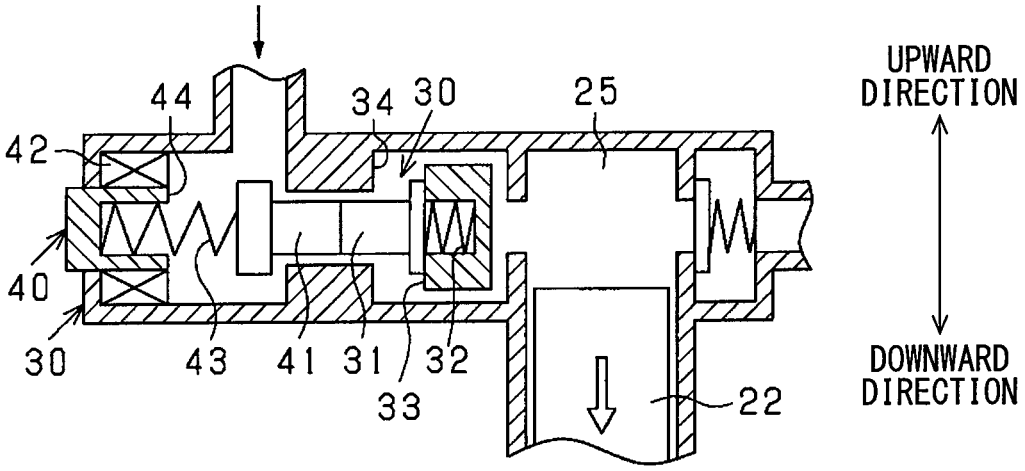
FIGS. 2(*a*) and 2(*b*) are schematic configuration diagrams showing states of a high pressure pump at the times of fuel suction and fuel discharge, respectively.
Figure 2:
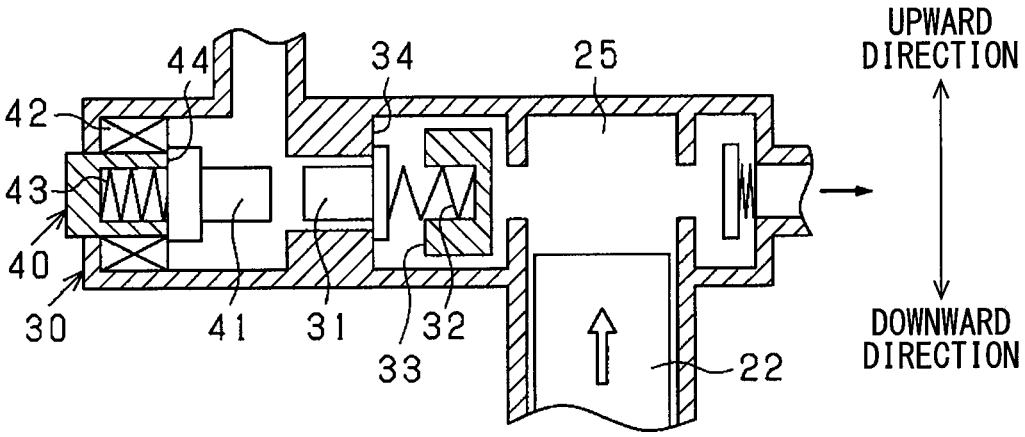

By switching the coil 42 between an energized state and a non-energized state, the movable part 41 abuts and separates from the valve body 31, so that the valve body 31 moves to open and close the valve. Specifically, as shown in FIG. 2(*a*), when the coil 42 is not energized and the movable part 41 is in the valve-opening position, the valve body 31 is pressed by the movable part 41. The valve body 31 is thereby maintained in a valve-opening position in which the valve body 31 is in contact with a stopper part 33, resisting the urging force of a spring 32 attached to the valve body 31. The stopper part 33 is a movement limiting member that limits the movement of the valve body 31. In this state, the valve body 31 is separated from a valve seat 34, so that the low pressure pipe 13 and the pressurization chamber 25 communicate with each other. This allows the low pressure fuel to be introduced into the pressurization chamber 25.

On the other hand, when the movable part 41 is in the valve-closing position as a result of energizing the coil 42, the valve body 31 is released from the pressure of the movable part 41. The valve body 31 is then, as shown in FIG. 2(*b*), seated in the valve seat 34 with the urging force of the spring 32, to be maintained in the valve-closing position. In this state, the flow of the fuel in the fuel suction passage 26 is shut off, and as a result, the low pressure is prevented from being introduced into the pressurization chamber 25.

Fuel suction and discharge of the high pressure pump 20 is described in detail below. When the regulating valve 30 is open and the plunger 22 moves to the side in which the capacity of the pressurization chamber 25 is increased (moves in a downward direction), the low pressure fuel in the low pressure pipe 13 is introduced, as the plunger 22 moves, into the pressurization chamber 25 via the fuel suction passage 26 (FIG. 2(*a*)). When the regulating valve 30 is closed and the plunger 22 moves to the side in which the capacity of the pressurization chamber 25 is decreased (moves in an upward direction), the fuel in the pressurization chamber 25 is exhausted, as the plunger 22 moves, from the pressurization chamber 25 to the fuel exhaust passage 27 (FIG. 2(*b*)). For the high pressure pump 20, a period of one fuel suction stroke and one fuel discharge stroke makes one pump-drive cycle Tp. The fuel is sucked and discharged by the repetition of the pump-drive cycles. The one pump-drive cycle Tp corresponds to one open-and-close period of the valve body 31.

The fuel discharge amount of the high pressure pump 20 is adjusted by controlling a valve-closing timing of the regulating valve 30. The valve-closing timing depends on the starting time for energizing the coil 42. Specifically, to raise the fuel pressure in the pressure accumulating pipe 14, the valve-closing timing of the regulating valve 30 is advanced by advancing the starting time for energizing the coil 42. As a result, the returning amount of the fuel when the plunger 22 moves in the upward direction is reduced, so that the fuel discharge amount of the high pressure pump 20 is increased. On the other hand, to reduce the fuel pressure in the pressure accumulating pipe 14, the valve-closing timing of the regulating valve 30 is retarded by retarding the starting time for energizing the coil 42. As a result, the returning amount of the fuel when the plunger 22 moves in the upward direction is increased, so that the fuel discharge amount of the high pressure pump 20 is decreased.

The pressurization chamber 25 is connected to the pressure accumulating pipe 14 via the fuel exhaust passage 27. A check valve 45 is provided in the fuel exhaust passage 27. The check valve 45 includes a valve body 46 and a spring 47. When the fuel pressure in the pressurization chamber 25 is equal to or higher than a predetermined pressure, the valve body 46 shifts its position that is a valve body position. Specifically, when the fuel pressure in the pressurization chamber 25 is lower than the predetermined pressure, the valve body 46 is maintained in the valve-closing position, with the urging force of the spring 47. This prevents the fuel from being discharged from the pressurization chamber 25 to the fuel exhaust passage 27. When the fuel pressure in the pressurization chamber 25 is equal to or higher than a predetermined pressure, the valve body 46 shifts its position, resisting the urging force of the spring 47 (the check valve 45 opens). This allows the fuel to be discharged from the pressurization chamber 25 to the fuel exhaust passage 27.

Other than those mentioned above, the present system is provided with various sensors such as a crank angle sensor 51 that outputs a crank angle signal in a rectangular form at each predetermined crank angle of the engine, and a current sensor 54 that detects an output current of the coil 42.

An ECU 50 is, as well known, formed mainly of a microcomputer (corresponding to a microcomputer 55) including a CPU, a ROM, and a RAM. The ECU 50 performs various engine-control functions, depending on the operating state of the engine of each time, by executing various control programs stored in the ROM. Specifically, detection signals from each of the aforementioned sensors and the like are input to the microcomputer 55. The microcomputer 55 computes, on the basis of the detection signals, controlled variables of various parameters related to the operation of the engine. At the same time, the microcomputer 55 controls the opening and closing of the injector 15 and the regulating valve 30, on the basis of computed values of the controlled variables. In the present embodiment, the ECU 50 corresponds to a control device of the high pressure pump 20.

When the regulating valve 30 is switched from an open state to a closed state and vice versa, the movable part 41 or the valve body 31 hits the stopper part, and so on. This causes a vibration that produces the operating sound. Specifically, when the regulating valve 30 closes, the movable part 41 moves to the valve-closing side by electromagnetic attraction force of the coil 42, and hits the stopper part 44, to produce a vibration. When the regulating valve 30 opens, the movable part 41 moves to the valve-opening side as a result of stopping energizing the coil 42, and hits the valve body 31, causing a vibration. In addition, pressed by the movable part 41, the valve body 31 hits the stopper part 33, which also produces a vibration. The operating sounds resulting from such vibrations are easily heard by an occupant of a vehicle, especially when the vehicle is running at a low speed or is not moving, making the occupant feel uncomfortable.

In view of the above, in the present embodiment, the high pressure pump 20 is driven by sound reducing control when a predetermined condition for performing the sound reducing control is met. In the sound reducing control, the operating sound of the high pressure pump 20 is reduced by energizing the coil in a mode different from that in the normal control time. Specifically, the ECU 50 includes a plurality of sound reducing parts, i.e. a first sound reducing part, a second sound reducing part, and a third sound reducing part. The operating sound is generated at a plurality of timings in one open-and-close period, as the valve body 31 makes opening and closing movements. Each of the sound reducing parts performs the sound reducing control at each of the plurality of timings. In a situation where the operating sound is noticeable, the plurality of the sound reducing parts works so as to reduce such operating sound. The normal control and the sound reducing control at the time of driving the high pressure pump 20 are described below, with reference to FIGS. 3 and 4.

Figure 3:
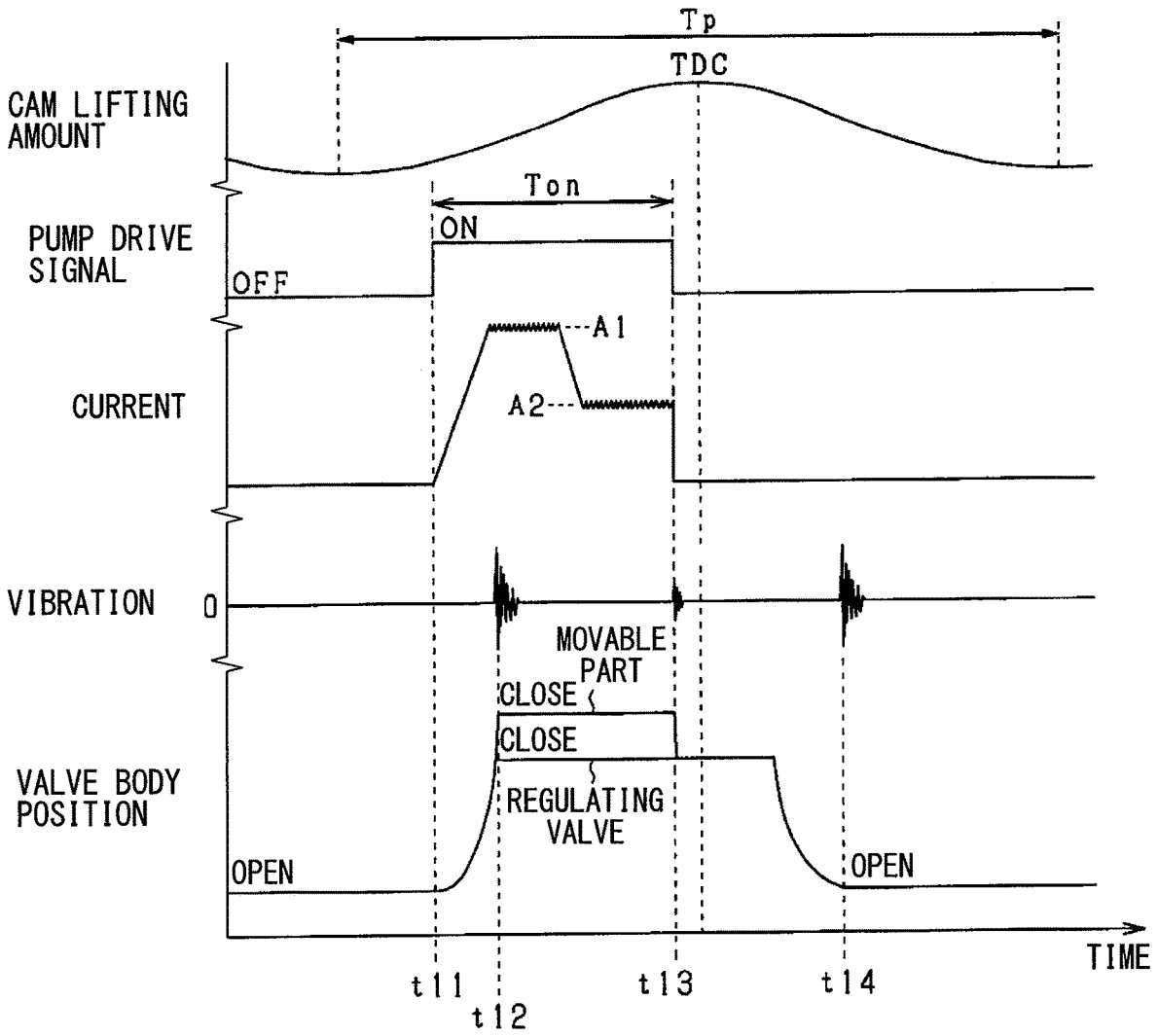
FIG. 3 is a time chart of driving of the high pressure pump in a normal control.
Figure 4:
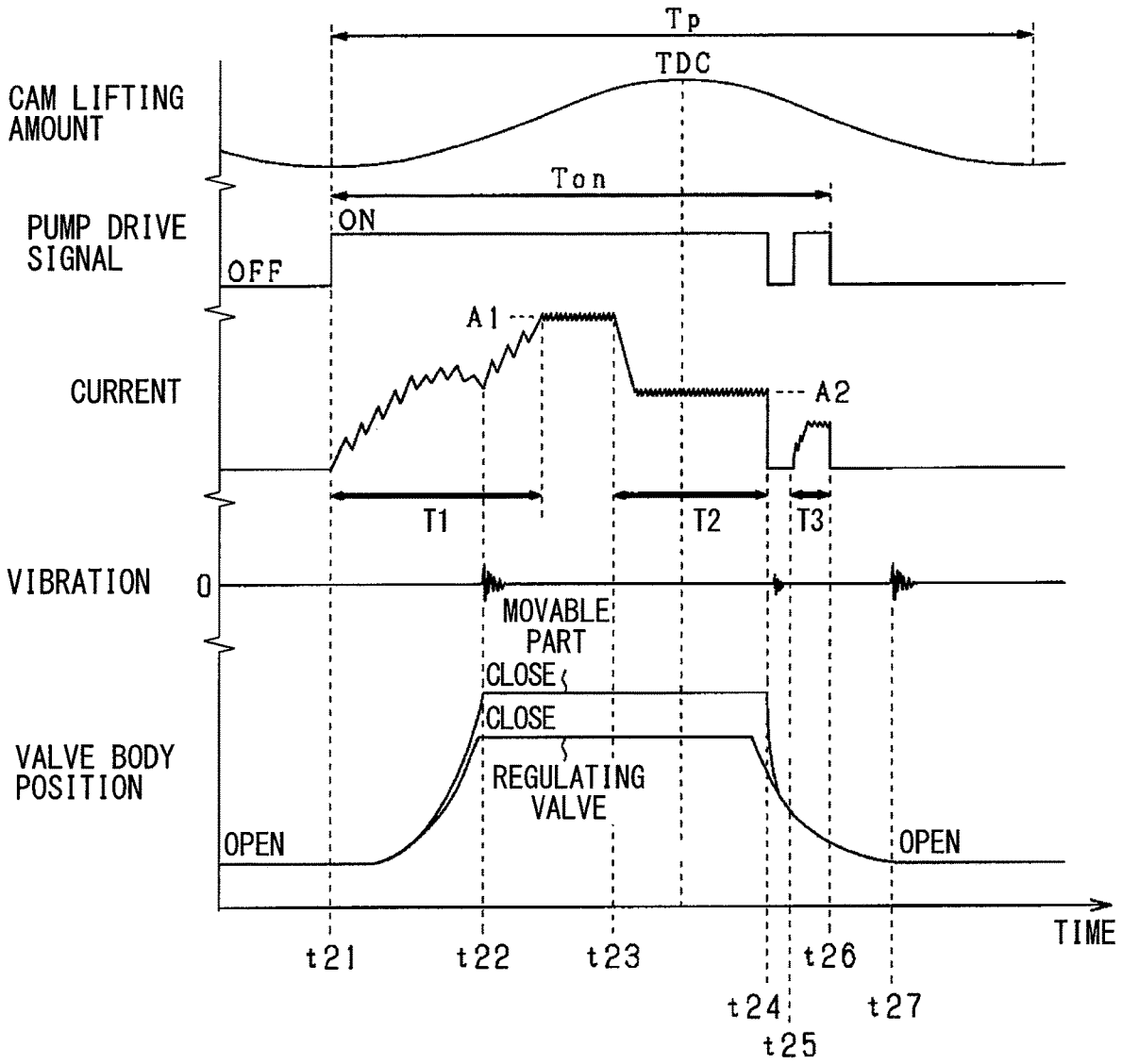
FIG. 4 is a time chart of driving of the high pressure pump in a sound reducing control.

FIG. 3 is a time chart of the normal control. The normal control is performed when the condition for performing the sound reducing control is not met. For example, the normal control is performed when a vehicle is running at a medium or a high speed and therefore the operating sound is unnoticeable. FIGS. 3 and 4 each show a single fuel discharge period of the high pressure pump 20.

In FIG. 3, a pump drive signal is switched from "off" to "on" at a valve-closing timing t11, during the time when the plunger 22 moves to the side in which the capacity of the pressurization chamber 25 is decreased. The valve-closing timing is calculated on the basis of a target fuel pressure that is a target value of the fuel pressure in the pressure accumulating pipe 14. In the normal control, first, voltage is applied to the coil 42 at a predetermined voltage duty cycle (e.g. 100%), so that a current flowing in the coil 42 is raised immediately to a valve-closing current that is a first current value A1. Subsequently, current control starts. Specifically, first constant current control is performed for a predetermined time. In the first constant current control, a coil current is controlled at a first current value A1. After that, second constant current control starts. In the second constant current control, the coil current is controlled at a holding current, i.e. a second current value A2 that is lower than the first current value. By the above controls of energizing, the movable part 41 is attracted toward the coil 42, and moves to the valve-closing position in which the movable part 41 is in contact with the stopper part 44. At a time t12, the valve body 31 gets seated in the valve seat 34, so that the valve is in the closed state. At this time, the movable part 41 and the valve body 31 hit the stopper part 44 and the valve seat 34, respectively, causing vibrations that produce the operating sounds.

When the regulating valve 30 opens, the pump drive signal is switched to "off" at a predetermined valve-opening timing t13, to stop energizing the coil 42. As a result of stopping energizing the coil 42, the movable part 41 moves to the valve-opening side, and hits the valve body 31. This produces a vibration smaller than that produced at the time of closing the valve. At a time t14, the valve body 31 moves further to the valve-opening side, and hits the stopper part 33, producing a vibration again. The vibration is as large as that produced at the time of closing the valve. The predetermined valve-opening timing t13 is, for example, a timing on or before the top dead center TDC of the plunger 22.

On the other hand, in the first sound reducing part for the sound reducing control, a voltage duty cycle lower than that of the normal control is set at the time of closing the regulating valve 30 in a period T1, so that the movable part 41 is driven by pulse-width modulation (PWM) control, as shown in FIG. 4. In this case, the movable part 41 moves to the valve-closing side at a speed slower than that of the normal control, and therefore, energy generated at a time t22 when the movable part 41 hits the stopper part 44 is small. Accordingly, a vibration and an operating sound produced at the hitting time t22 are small.

As a coil current is raised slowly to a first current value A1, a temporary reduction of the current occurs at the time t22 in the course of raising the current. Such change in the current is due to a change in inductance of the coil 42. The change in the inductance occurs because the movable part 41 comes close to the coil 42. The time t22 at which the temporary reduction of the current has occurred indicates that the movable part 41 has moved to the valve-closing position, in other words, the regulating valve 30 is in the closed state.

After raising the coil current to the first current value A1 by PWM drive, first and second constant current controls are performed, as with the normal control. However, in the second sound reducing part for the sound reducing control, in a period T2, a period during which a second current value A2 is maintained is longer than in the case of the normal control, so as to extend a period during which the movable part 41 is maintained in the valve-closing side.

In valve-opening control for sound reduction, a period during which the movable part 41 is maintained in the valve-closing side is extended. At the time of opening the regulating valve 30, the fuel pressure in the pressurization chamber 25 is still high at the top dead center TDC of the plunger 22, and in the vicinity of the TDC. The fuel pressure in the pressurization chamber 25, therefore, acts in such direction that the regulating valve 30 moves to the valve-closing side. As a result, a large vibration is produced when the movable part 41 bumps against the regulating valve 30, as shown around a time t13 in FIG. 3. Due to the vibration, an operating sound is produced.

Figure 5:
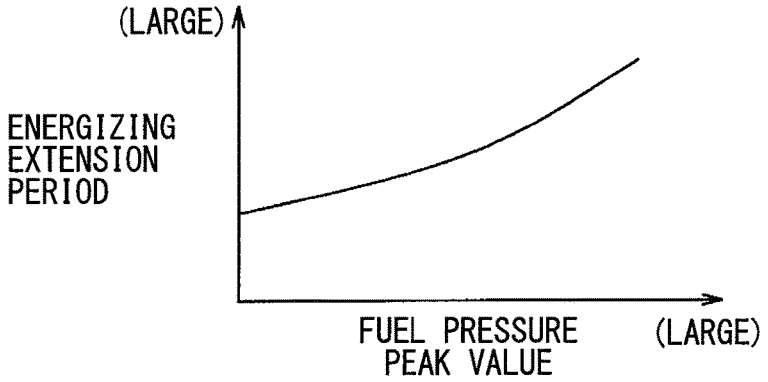
FIG. 5 is a diagram showing a relation between a fuel pressure peak value and a valve-opening period of the regulating valve.

In view of the above, in the valve-opening control for sound reduction, energizing the coil 42 is stopped at a timing later than that in the normal control. As a result, the fuel pressure in the pressurization chamber 25 is sufficiently reduced, so that the movable part 41 bumps against the regulating valve 30 after the valve body 31 of the regulating valve 30 starts to move to the valve-opening side. Specifically, in the valve-opening control for sound reduction, energizing the coil 42 is stopped at a time t24 that is after the top dead center of the plunger 22. In this case, as the fuel pressure in the pressurization chamber 25 is higher, the amount of descent of a cam lift, which is required until the fuel pressure in the pressurization chamber 25 reduces sufficiently, becomes larger. Considering the above, in the present embodiment, an extension period of energizing the coil 42 is longer, as the peak value of the fuel pressure in the pressurization chamber 25 is higher, as shown in FIG. 5. According to the present embodiment, the extension period is an energizing extension period, and the peak value is a fuel pressure peak value.

When energizing the coil 42 is stopped at the time t24, the movable part 41 starts to move to the valve-opening side, and bumps against the valve body 31, producing a vibration. At this time, by stopping energizing the coil 42 at a timing later than that in the normal control, a vibration produced when the movable part 41 bumps against the valve body 31 is smaller than that in the normal control.

Further, in the valve-opening control for sound reduction, the coil 42 is temporarily re-energized by using the third sound reducing part, after energizing the coil 42 is stopped at the time t24, and before the movable part 41 reaches the valve-opening position. The coil 42 is re-energized in a period T3 between a time t25 and a time t26. As a result, electromagnetic attraction force is temporarily generated in the coil 42. The electromagnetic attraction force reduces the movement speed at which the movable part 41 moves to the valve-opening side. By the above energizing control, a vibration is small when the valve body 31 hits the stopper part 33 at a time t27, which reduces an operating sound generated as a result of the vibration. At the time of temporary re-energizing the coil 42 by the third sound reducing part, a current applied is low enough to prevent the movable part 41 from returning in the valve-closing direction.

The first sound reducing part corresponds to a valve-closing-time sound reducing part that reduces the operating sound produced when the regulating valve 30 closes. The second and third sound reducing parts correspond to valve-opening-time sound reducing parts that reduce the operating sounds produced when the regulating valve 30 opens.

In the meantime, an upper limit can be set on a coil-energizing period for each pump-drive cycle Tp, due to limitations by hardware and so on. For example, when a period of energizing the coil 42 is too long, a drive circuit of the coil 42 may be overheated. Considering this, in the present system, in order to prevent the coil drive circuit from overheating, an upper limit value is set on a coil-energizing period for each pump-drive cycle Tp. When energizing and non-energizing are repeated for a plurality of times, an upper limit value is set on the sum of a plurality of coil-energizing periods for each pump-drive cycle Tp.

When the high pressure pump 20 is driven by the sound reducing control, a coil-energizing period for each pump-drive cycle Tp changes depending on, for example, an operating state of the engine at each time. In some cases, a required period of energizing the coil 42 in one cycle Tp exceeds the upper limit value. For example, when the fuel pressure in the pressure accumulating pipe 14 is high, a period during which the second current value A2 is maintained is extended, and accordingly, the coil-energizing period for each pump-drive cycle Tp is extended. As a result, the coil-energizing period may exceed the upper limit value.

In addition, when the movable part 41 is PWM driven, power supplied to the coil 42 can be variable on the basis of a result of determining whether the high pressure pump 20 has operated in response to switching the pump drive signal on. In this way, the movable part 41 can be closed at an operation power limit that is the minimum required power to move the movable part 41 to the valve-closing position, as well as enabling fuel discharge from the high pressure pump 20. In such control, the length of the period of energizing by PWM drive, i.e. the period T1, changes. Accordingly, the coil-energizing period in one pump-drive cycle Tp changes. Due to this, when the high pressure pump 20 is driven by the sound reducing control, the coil-energizing period in one pump-drive cycle Tp may exceed the upper limit value. In this case, however, it is desirable to effectively have a sound reducing effect within the limitations by the hardware.

For this purpose, in the present embodiment, when a predetermined condition for performing the sound reducing control is met, basically all the plurality of the sound reducing parts, i.e. the first, second, and third sound reducing parts are operated, in order to have a sound reducing effect effectively. When a required time for energizing the coil 42 in one pump-drive cycle Tp exceeds a predetermined upper limit value due to operating all the plurality of the sound reducing parts, one or more of the plurality of the sound reducing parts are selected to the extent that the required period does not exceed the upper limit value, and the selected sound reducing part(s) is/are operated. In the present embodiment, the ECU 50 functions as the following: the sound reducing parts; an upper limit determination part that determines whether a required time for energizing the coil 42 in one pump-drive cycle Tp exceeds a predetermined upper limit value; and a selectively operating part that selects and operates one or more of the plurality of the sound reducing parts to the extent that the required period does not exceed the upper limit value.

As a process of selecting one or more of the plurality of the sound reducing parts, in the present embodiment, an efficiency in the sound reducing effect, and an efficiency in the effect of reducing the energizing period by not operating are particularly considered in respect to the plurality of the sound reducing parts. One or more of the plurality of the sound reducing parts are selected according to the order of priority determined on the basis of the above efficiencies.

Next, processing steps in the sound reducing control of the present embodiment are described below with reference to a flowchart in FIG. 6. The processing is executed by the microcomputer 55 in each predetermined cycle.

Figure 6:
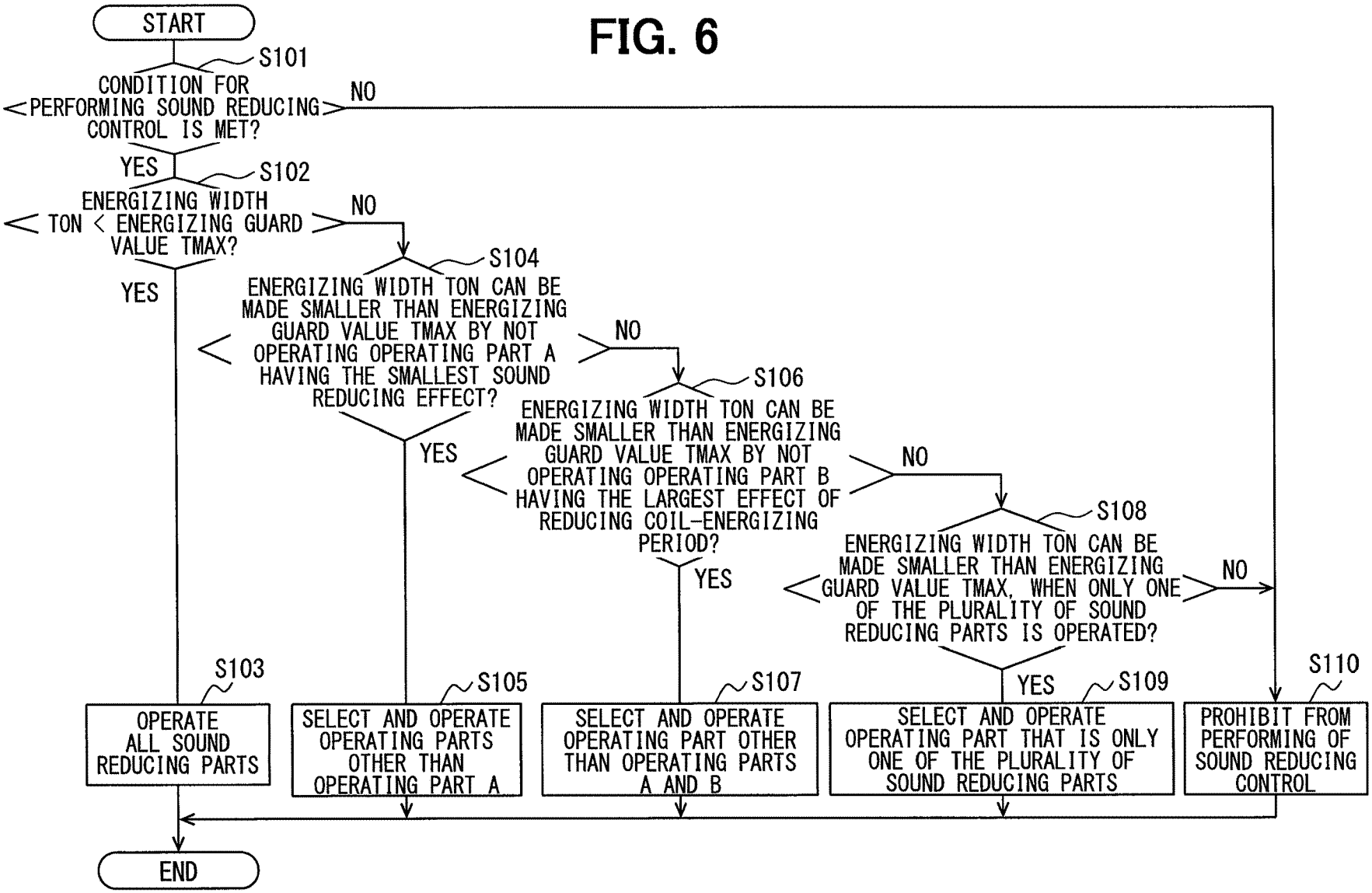
FIG. 6 is a flowchart showing processing steps of the sound reducing control.

In step S101 in FIG. 6, it is determined whether a condition for performing the sound reducing control is met. Examples of the condition for performing the sound reducing control include: (1) The value of battery voltage is equal to or higher than a predetermined value; (2) The vehicle is running at a low speed or is not moving (in other words, the value of the vehicle speed is equal to or lower than a predetermined value); (3) An accelerator is not operated; (4) The value of the fluctuation range of the engine rotation speed is equal to or lower than a predetermined value, or the engine rotation speed is in a steady state; (5) Deviation of an actual fuel pressure in the pressure accumulating pipe 14 from a target fuel pressure is equal to or lower than a predetermined value. In step S101, the result is determined to be positive (YES), when all the conditions (1) to (5) are met.

When the condition for performing the sound reducing control is not met, the processing proceeds to step S110, in which performing the sound reducing control is prohibited, and the control mode is switched from the sound reducing control to the normal control. In such a case, drive control of the electromagnetic actuator 40 is performed in the normal control. When all the conditions for performing the sound reducing control are met, the processing proceeds to step S102. In step S102, an energizing width Ton is calculated. The energizing width Ton is the coil-energizing period in one pump-drive cycle Tp with all the plurality of the sound reducing parts operated. It is then determined whether a calculated value of the energizing width Ton is smaller than an energizing guard value Tmax.

As shown in FIGS. 3 and 4, the energizing width Ton means a period from the time when energizing the coil is started for the purpose of switching the state of the regulating valve 30 from "open" to "closed" to the time when the energizing the coil is finally stopped for the purpose of switching the state of the regulating valve 30 from "closed" to "open". The energizing width Ton is calculated using a target value of the fuel discharge amount calculated on the basis of the operating state of the engine, an energizing extension period read from the map in FIG. 5, and so on. The energizing guard value Tmax is set, in the present embodiment, at a maximum value determined in terms of thermal protection of the drive circuit of the coil 42. For example, in the present embodiment, the maximum value is 60% or 70% with respect to one pump-drive cycle Tp.

When the value of the energizing width Ton is smaller than the energizing guard value Tmax, the result is determined to be positive (YES) in step S102, and the processing proceeds to step S103. In step S103, the high pressure pump 20 is driven by operating all the first, second, and third sound reducing parts. When the value of the energizing width Ton is larger than the energizing guard value Tmax, the processing proceeds to step S104. In step S104, it is determined whether the energizing width Ton can be made smaller than the energizing guard value Tmax by not operating an operating part A having the smallest sound reducing effect among the sound reducing parts. An operating part that is operated at a timing when an operating sound produced is the smallest in the normal control is selected as the operating part A. In the present embodiment, the second sound reducing part is selected as the operating part A. Step S104 corresponds to an allowance determining part.

When the result is determined to be positive (YES) in step S104, the processing proceeds to step S105. In step S105, the operating parts other than the operating part A (in the present embodiment, the first and third sound reducing parts) are selected among a plurality of the operating parts for the sound reducing control. The high pressure pump 20 is driven by operating the selected sound reducing parts. In this case, in the period corresponding to the timing of the operation of the operating part A, the coil 42 is energized in an energizing mode of the normal control. For example, when the second sound reducing part is selected as the operating part A, energizing the coil 42 is stopped temporarily at a timing on or before the top dead center TDC of the plunger 22, after the movable part 41 is moved to the valve-closing position by PWM drive. Subsequently, the coil 42 is re-energized temporarily at a timing t25, after the fuel pressure in the pressurization chamber 25 has sufficiently decreased, and the valve body 31 has started to move to the valve-opening side.

On the other hand, when the result is determined to be negative (NO) in step S104, the processing proceeds to step S106. In step S106, it is determined whether the energizing width Ton can be made smaller than the energizing guard value Tmax by not operating an operating part B having the largest effect of reducing a coil-energizing period when back to the normal control, among the sound reducing parts other than the operating part A. An operating part for which the energizing period changed to increase relative to the normal control time is the largest is selected as the operating part B, among the sound reducing parts other than the operating part A. In the present embodiment, the first sound reducing part is selected as the operating part B. Step S106 corresponds to the allowance determining part. In the present embodiment, when the period of energizing the coil 42 is changed to increase relative to the normal control time, the operating sounds are reduced by slowing the movement speeds of the valve body 31 and the movable part 41, or energizing is continued so as to maintain the valve body 31 and the movable part 41 in predetermined positions. In other words, examples of specific mode of "changing the period of energizing the electromagnetic part to increase relative to the normal control time" include reducing the operating sound by slowing the movement speed of the valve body, and continuing energizing so that the valve body can be maintained in the predetermined position.

When the result is determined to be positive (YES) in step S106, the processing proceeds to step S107. In step S107, the operating part other than the operating parts A and B (in the present embodiment, the third sound reducing part) is selected among the plurality of the sound reducing parts. The high pressure pump 20 is driven by operating the selected operating part.

At this time, in the periods corresponding to the timings of the operation of the operating parts A and B, the coil 42 is energized in an energizing mode of the normal control. Specifically, when the second sound reducing part is selected as the operating part A, and the first sound reducing part is selected as the operating part B, the regulating valve 30 is rapidly closed by raising the coil current to the first current value A1 immediately, and then energizing the coil 42 is stopped temporarily at a timing on or before the top dead center TDC of the plunger 22. Subsequently, the coil 42 is re-energized temporarily at the timing t25, after the fuel pressure in the pressurization chamber 25 has sufficiently decreased, and the valve body 31 has started to move to the valve-opening side.

When the result is determined to be negative (NO) in step S106, the processing proceeds to step S108. In step S108, it is determined whether the energizing width Ton can be made smaller than the energizing guard value Tmax, when only one of the plurality of the sound reducing parts is operated.

When the result is determined to be positive (YES) in step S108, the processing proceeds to step S109. In step S109, an operating part that is the only one of the plurality of the sound reducing parts is selected, and the selected operating part is operated as the sound reducing control. When there are two or more sound reducing parts each of which is operated to make the energizing width Ton be smaller than the energizing guard value Tmax, an operating part that achieves the greatest efficiency in the sound reducing effect is selected from such sound reducing parts. When the result is determined to be negative (NO) in step S108, the processing proceeds to step S110. In step S110, performing the sound reducing control is prohibited, and the control mode is switched from the sound reducing control to the normal control.

The present embodiment described in detail above has the following advantageous effects.

When a predetermined condition for performing the sound reducing control is met, basically all the plurality of the sound reducing parts are operated. However, when a required time for energizing the coil 42 in one pump-drive cycle Tp exceeds a predetermined upper limit value due to operating all the plurality of the sound reducing parts, one or more of the plurality of the sound reducing parts are selected to the extent that the required period does not exceed the upper limit value, and the selected sound reducing part(s) is/are operated. In the high pressure pump 20, when the sound reducing control is performed to reduce the operating sound of the regulating valve 30, the coil-energizing period in one open-and-close period of the valve body 31 is extended. As a result, the sound reducing control may be limited by, for example, an upper limit value that is determined in terms of hardware protection. On this point, with the configuration described previously, the sound reducing control is performed positively on one or more of the plurality of the sound reducing parts, instead of canceling the sound reducing control entirely. As a result, the operating sound caused by opening and closing the regulating valve 30 is reduced as much as possible, within the limitations on the coil-energizing period.

When it is determined that the energizing width Ton exceeds the energizing guard value Tmax by operating all the plurality of the sound reducing parts, one or more of the plurality of the sound reducing parts are selected on the basis of the efficiency in the sound reducing effect in respect to each of the plurality of the sound reducing parts, and the selected sound reducing part(s) is/are operated. Specifically, the operation of the operating part A having the smallest sound reducing effect among the plurality of the sound reducing parts is stopped, so that the operating parts other than the operating part A are operated. Efficiency in the sound reducing effect differs among each of the plurality of the sound reducing parts. One sound reducing part has a low efficiency in the sound reducing effect. When the operation of such a sound reducing part is stopped, the sound reducing effect is not much affected. Another sound reducing part, on the other hand, has a high efficiency in the sound reducing effect. When the operation of such a sound reducing part is stopped, the sound reducing effect for the entire pump is not produced effectively. Viewed in this light, with the configuration described previously, only one or more of the plurality of the sound reducing parts are selectively operated, so that the reduction of the operating sound is achieved as effectively as possible within the limitations by the hardware.

When it is determined that the energizing width Ton exceeds the energizing guard value Tmax by operating all the plurality of the sound reducing parts, one or more of the plurality of the sound reducing parts are selected on the basis of the efficiency in the effect of reducing the energizing period in respect of each of the plurality of the sound reducing parts, and the selected sound reducing part(s) is/are operated. Specifically, the operation of the operating part B having the largest effect of reducing the energizing period among the plurality of the sound reducing parts is stopped, so that the operating parts other than the operating part B are operated. Efficiency in the effect of reducing the energizing period differs among each of the plurality of the sound reducing parts. One sound reducing part has a high efficiency in the effect of reducing the energizing period that is a time reducing effect. It is avoided, therefore, that the energizing width Ton exceeds the energizing guard value Tmax, by stopping the operation of such sound reducing part only. Another sound reducing part, on the other hand, has a low efficiency in the effect of reducing the energizing period. It cannot be prevented, in this case, that the energizing width Ton exceeds the energizing guard value Tmax, by stopping the operation of such sound reducing part only. Viewed in this light, with the configuration described previously, only one or more of the plurality of the sound reducing parts are selectively operated, which means as many sound reducing parts as possible are operated, while thermal protection of the coil drive circuit is accomplished.

When one or more of the plurality of the sound reducing parts are selected to be operated in one open-and-close period of the valve body 31, the one or more selected sound reducing parts are operated provided that it has been determined that the energizing width Ton does not exceed the energizing guard value Tmax when the selected sound reducing parts are operated. In the first sound reducing part that performs PWM driving, and in the second sound reducing part that delays the timing of stopping energizing, the energizing period for the sound reducing differs depending, for example, on the operating state of the engine of each time. For this reason, whether or not the energizing width Ton exceeds the energizing guard value Tmax may change at each time, even for the same combination of sound reducing parts selected from the plurality of the sound reducing parts. On this point, with the configuration described previously, the energizing width Ton and the energizing guard value Tmax are actually compared with each other, when one or more of the plurality of the sound reducing parts are selected to be operated. The selected sound reducing parts are operated, provided that it has been determined that the energizing width Ton does not exceed the energizing guard value Tmax. It is thereby ensured that the energizing width Ton does not exceed the energizing guard value Tmax. The present embodiment, therefore, is suitable in terms of thermal protection of the coil drive circuit.

In one open-and-close period of the valve body 31, vibrations are produced at least at the timing, in the case of closing the regulating valve 30, when the movable part 41 hits the stopper part 44 as a movement limiting member, and at the timing, in the case of opening the regulating valve 30, when the valve body 31 hits the stopper part 33. Operating sounds are generated as a result of the vibrations. Viewed in this light, the present system includes the valve-closing-time sound reducing part that reduces the operating sound produced when the regulating valve 30 closes, and the valve-opening-time sound reducing part that reduces the operating sound produced when the regulating valve 30 opens. With this configuration, energizing is controlled to reduce the operating sounds at each of the plurality of the timings when the operating sounds are generated as a result of opening and closing the regulating valve 30. This makes it possible to effectively accomplish the reduction of the operating sounds.

The first, second, and third sound reducing parts are different in efficiencies in the sound reducing effect, and the effect of reducing the time when not operating. In addition, when all the sound reducing parts are operated, the coil-energizing period for sound reduction is prolonged in some operating state of the engine, and, as a result, the energizing width Ton is likely to exceed the energizing guard value Tmax. Based on the above, the system including the first to third sound reducing parts as sound reducing controls applies such controls in the following way. When performing the sound reducing control does not need to be limited, the system effectively produces the sound reducing effect by operating all the sound reducing controls. At the same time, when performing the sound reducing control needs to be limited in terms of, for example, thermal protection of the coil drive circuit, the system is able to produce the sound reducing effect as effectively as possible while accomplishing the thermal protection of the coil drive circuit, by limiting the operation of part of the sound reducing controls.

Other Embodiments

The present disclosure is not limited to the above-described embodiment. Examples of alternative embodiments are described below.

In the above-described embodiment, when it is determined that the energizing width Ton exceeds the energizing guard value Tmax by operating all the plurality of the sound reducing parts, one or more of the plurality of the sound reducing parts are selected firstly on the basis of the efficiency in the sound reducing effect, and subsequently, one or more of the rest of the sound reducing parts are selected on the basis of the efficiency in the effect of reducing the time. However, the embodiment in which one or more of the plurality of the sound reducing parts are selected is not limited to the above. For example, one or more of the plurality of the sound reducing parts may be selected on the basis of the efficiency in the effect of reducing the time first, before selecting on the basis of the efficiency in the sound reducing effect.

At the time of selecting one or more of the plurality of the sound reducing parts, only one of the efficiency in the sound reducing effect and the efficiency in the effect of reducing the time may be considered. Specifically, in the case of considering the efficiency in the sound reducing effect only, when it is determined that the energizing width Ton exceeds the energizing guard value Tmax by operating all the plurality of the sound reducing parts, the operation of the operating part A having the smallest sound reducing effect is stopped first, and then the rest of the operating parts are selected as the sound reducing parts to be operated. When it is determined that the energizing width Ton cannot be made smaller than the energizing guard value Tmax by stopping the operation of the operating part A, the operation of the operating part AX that has the smallest sound reducing effect after the operating part A, in addition to the operation of the operating part A, are stopped. Accordingly, the rest of the operating parts are selected as the sound reducing parts to be operated.

Operations of one or more of the plurality of the sound reducing parts may be stopped according to stop-priority order, so that the rest of the sound reducing parts may be selected and operated. The stop-priority order is the order of stopping operation of the plurality of the sound reducing parts, which is predetermined on the basis of the efficiencies in the sound reducing effect and in the effect of reducing the time of the sound reducing parts. The stop-priority order is stored in advance. Specifically, as for the sound reducing effect, the first and third sound reducing parts have a large effect, whereas the second sound reducing part does not have that great effect. As for the effect of reducing the time, while the first and second sound reducing parts have a large effect as a result of stopping operation thereof, the third sound reducing part does not have that great effect. Taking the above into consideration, in the present embodiment, the stop-priority order is set as shown in FIG. 7, so that the sound reducing parts can stop operating in the following order: the second sound reducing part, the first sound reducing part, and the third sound reducing part. When, therefore, it is determined that the energizing width Ton exceeds the energizing guard value Tmax by operating all the plurality of the sound reducing parts, the operation of the second sound reducing part is stopped first, so that the rest of the operating parts are selected.

The above-described embodiment includes, as the plurality of the sound reducing parts, the first sound reducing control that is operated when the regulating valve 30 closes, as well as the second and third sound reducing controls that are operated when the regulating valve 30 opens. In the above-described embodiment, when it is determined that the energizing width Ton exceeds the energizing guard value Tmax by operating all the sound reducing controls, one or more of the first to third sound reducing controls are selected to be operated. In a modified embodiment, when it is determined that the energizing width Ton exceeds the energizing guard value Tmax by operating all the plurality of the sound reducing parts, either the valve-closing-time sound reducing part or the valve-opening-time sound reducing part is selected, and the selected operating part is operated. In this case, when the valve-closing-time sound reducing part is selected, the first sound reducing part only is operated. When the valve-opening-time sound reducing part is selected, the second and third sound reducing parts are operated.

In the above-described embodiment, the energizing extension period during which the movable part 41 is maintained in the valve-closing position by the second sound reducing part is set on the basis of the peak value of the fuel pressure. The energizing extension period, however, may be set by taking into consideration another parameter such as a fuel temperature. In this case, as the fuel temperature is higher, the energizing extension period is set longer.

The above-described embodiment includes three operating parts as the plurality of the sound reducing parts, i.e. the first, second, and third sound reducing parts. The embodiment may be applied to a configuration including only two out of the three operating parts. The number of the sound reducing parts may be four or more.

At the time of determining whether the required period of energizing the coil 42 in one open-and-close period of the valve body 31 exceeds the predetermined upper limit value, the energizing width Ton is used as the required period of energizing. However, an actual energizing period of the energizing width Ton may be compared with the upper limit value.

In the above-described embodiment, it is determined whether the energizing width Ton is smaller than the energizing guard value Tmax when one or more of the plurality of the sound reducing parts are selectively operated. The selected sound reducing parts are operated provided that it has been determined that the energizing width Ton does not exceed the energizing guard value Tmax. It is not necessary, however, to provide such determining part (the allowance determining part). For example, when an embodiment is configured in such a manner that the energizing width Ton does not exceed the energizing guard value Tmax as long as only one of the plurality of the sound reducing parts is selectively operated, the selected one sound reducing part may be operated without the aforementioned determination.

In the above-described embodiment, when it is determined that the energizing width Ton exceeds the energizing guard value Tmax by operating all the plurality of the sound reducing parts, the operation of one operating part among the plurality of the sound reducing parts is stopped. However, operation of two operating parts may be stopped.

In the above-described embodiment, the present disclosure is applied to the system including the regulating valve 30 that is of a normally-open-type and is open in a non-energized period. However, the present disclosure may also be applied to a system including a regulating valve that is of a normally-closed-type and is closed in a non-energized period.

In the above-described embodiment, the present disclosure is applied to the fuel supply system including the regulating valve 30 having two valve bodies (the valve body 31 and the movable part 41). However, the present disclosure may also be applied to a fuel supply system including a regulating valve having a single valve body. Specifically, the present disclosure is applied to the system having the regulating valve placed, in the form of the valve body, in a fuel suction passage communicating with a pressurization chamber. The valve body is able to be shifted by switching a coil between an energized state and a non-energized state. The valve body is configured to supply fuel to the pressurization chamber and shut off the fuel supply to the pressurization chamber, as a result of shifting the position thereof. In the system, an operating sound is generated due to a vibration produced when the valve body hits a stopper part at each time of closing and opening the valve. The present disclosure, therefore, is able to be applied to such system in order to accomplish the reduction of the sound, in such a manner that the first and third sound reducing parts are operated at the time of closing and opening the valve, respectively.

In the above-described embodiment, a gasoline engine is applied as the internal-combustion engine. However, a diesel engine may be applicable. Specifically, the present disclosure may be formed as a control device of a common-rail-type fuel supply system of a diesel engine.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A control device for a high pressure pump the high pressure pump including a plunger that reciprocates with rotation of a rotating shaft so that a capacity of a pressurization chamber is variable, and a regulating valve having a valve body placed in a fuel suction passage communicating with the pressurization chamber, the regulating valve configured to close the fuel suction passage supplying fuel to the pressurization chamber when an electromagnetic part is in an energized state and configured to open the fuel suction passage shutting off fuel supply to the pressurization chamber when the electromagnetic part is in a non-energized state, as a result of moving the valve body by switching the electromagnetic part between the energized state and the non-energized state, and the regulating valve is further configured to adjust a fuel discharge amount of the high pressure pump by switching the regulating valve between an open state and a closed state, the control device comprising:

a plurality of sound reducing parts that are operated individually, when a predetermined condition for operation of the control device in a sound reducing control mode is met, at each of a plurality of timings when an operating sound is generated as a result of a movement of the valve body, in one open-and-close period in which the valve body makes an opening movement and a closing movement, and that are each configured to reduce an operating sound that is generated as a result of a movement of the valve body, at each of the plurality of the timings, by increasing a required period of energizing the electromagnetic part relative to that in a normal control time;

an upper limit determination part that determines whether the increased required period of energizing the electromagnetic part in the one open-and-close period exceeds a predetermined upper limit value, when all the plurality of the sound reducing parts are operated; and a selectively operating part configured to operate the plurality of the sound reducing parts in the one open-and-close period, wherein the selectively operating part:

selects at least one of the plurality of the sound reducing parts according to an order of priority determined in advance on the basis of at least one of an effect of reducing the operating sound or an effect of reducing an energizing period of the electromagnetic part and operates the at least one of the plurality of the sound reducing parts, and prohibits the remaining one or more of the plurality of the sound reducing parts to an extent that the required period of energizing does not exceed the upper limit value, when the upper limit determination part has determined that the required period of energizing exceeds the upper limit value.

2. The control device for a high pressure pump according to claim 1, wherein the selectively operating part selects and operates one or more of the plurality of the sound reducing parts and prohibits the remaining one or more of the plurality of the sound reducing parts, based on efficiency in sound reducing effect in respect to each of the plurality of the sound reducing parts.

3. The control device for a high pressure pump according to claim 1, wherein the selectively operating part selects and operates one or more of the plurality of the sound reducing parts and prohibits the remaining one or more of the plurality of the sound reducing parts, based on efficiency in effect of reducing an energizing period in respect to each of the plurality of the sound reducing parts.

4. The control device for a high pressure pump according to claim 1, further comprising:

an allowance determining part that determines whether the required period of energizing the electromagnetic part in the one open-and-close period exceeds a predetermined upper limit value, when one or more of the plurality of the sound reducing parts is/are operated, wherein the selectively operating part operates the selected sound reducing part or parts, provided that the allowance determining part has determined that the required period of energizing does not exceed the upper limit value.

5. The control device for a high pressure pump according to claim 1, wherein the plurality of the sound reducing parts include a valve-closing-time sound reducing part that reduces the operating sound produced when the regulating valve closes, and a valve-opening-time sound reducing part that reduces the operating sound produced when the regulating valve opens.

6. The control device for a high pressure pump according to claim 1, wherein the regulating valve includes a first valve body that allows or shuts off, as the valve body, a flow of fuel in the fuel suction passage, and a second valve body that is placed in such a manner as to be movable in a same direction as a direction of the opening and closing movements of the first valve body, the second valve body causing the first valve body to make the opening and closing movements by abutting and separating from the first valve body due to switching the electromagnetic part between the energized state and the non-energized state, and the plurality of the sound reducing parts includes a first sound reducing part that reduces the operating sound at the time of closing the regulating valve, by causing the valve body to move at a slower speed than that in the normal control time, a second sound reducing part that reduces the operating sound produced when the first and second valve bodies come in contact with each other, and a third sound reducing part that reduces the operating sound at the time of opening the regulating valve, by causing the valve body to move at a slower speed than that in the normal control time.

7. The control device for a high pressure pump according to claim 1, wherein the selectively operating part operates all of the plurality of the sound reducing parts on determination of that upper limit determination part that the required period of energizing is equal to or less than the upper limit value.

8. The control device for a high pressure pump according to claim 7, wherein the regulating valve further includes a movable part movable to abut onto and to separate from the valve body to cause the valve body to open and close the fuel suction passage on de-energization and energization of the electromagnetic part.

9. The control device for a high pressure pump according to claim 8, wherein the plurality of the sound reducing parts includes a first sound reducing part that sets a voltage duty cycle of the electromagnetic part lower than that of the normal control time in a period after a bottom dead center of the plunger and before a top dead center of the plunger.

10. The control device for a high pressure pump according to claim 9, wherein the selectively operating part selects and operates the first sound reducing part and prohibits the remaining one or more of the plurality of the sound reducing parts, based on the order of priority determined on the basis of efficiencies in reducing an energizing period.

11. The control device for a high pressure pump according to claim 8, wherein the plurality of the sound reducing parts includes a second sound reducing part that stops energization of the electromagnetic part at a timing which is after a top dead center of the plunger and is later than that in the normal control time.

12. The control device for a high pressure pump according to claim 11, wherein the selectively operating part prohibits the second sound reducing part based on efficiency in sound reducing effect.

13. The control device for a high pressure pump according to claim 8, wherein the plurality of the sound reducing parts includes a third sound reducing part that temporarily re-energizes the electromagnetic part after stoppage of energizing of the electromagnetic part and before the valve body stops at a valve-opening position.

14. The control device for a high pressure pump according to claim 7, wherein the selectively operating part prohibits all of the plurality of the sound reducing parts in the normal control time.

15. The control device for a high pressure pump according to claim 1, wherein the selectively operating part allows the selectively operating part to select and to operate the one or more of the plurality of the sound reducing parts and to prohibit the remaining one or more of the plurality of the sound reducing parts based on the determination and subsequently allows the selectively operating part to operate all of the plurality of the sound reducing parts on determination of the upper limit determination part that the required period of energizing is equal to or less than the upper limit value.

16. The control device according to claim 1 wherein the selectively operating part determines the order of priority on the basis of an efficiency in the sound reducing effect of each of the plurality of sound reducing parts.

17. The control device according to claim 16 wherein the selectively operating part calculates a maximum required period in a case where all of the plurality of sound reducing parts reduce the operating sound, by calculating a summation of required periods for the plurality of sound reducing parts in the one open-and-close period.

18. The control device according to claim 17 wherein the selectively operating part prohibits the remaining one or more of the plurality of the sound reducing parts on determination that the maximum required period exceeds the upper limit value.

19. The control device for a high pressure pump according to claim 1, wherein the selectively operating part prohibits the remaining one or more of the plurality of the sound reducing parts, which is the lowest in the priority, when the upper limit determination part has determined that the required period of energizing exceeds the upper limit value.

20. The control device for a high pressure pump according to claim 19, wherein the upper limit value is a value that is set in order to prevent the coil drive circuit from overheating.

21. The control device for a high pressure pump according to claim 1, further comprising:

a part that is operated in the normal control time at each of the plurality of timings when the operating sound is generated not to reduce the operating sound.

22. The control device for a high pressure pump according to claim 1, wherein the selectively operating part selects the at least one of the plurality of the sound reducing parts according to the order of priority determined in advance on the basis of the effect of reducing the operating sound, and operates the selected at least one of the plurality of the sound reducing parts.

23. A control device for a high pressure pump, the high pressure pump including a plunger that reciprocates to manipulate a capacity of a pressurization chamber, a valve body in a fuel suction passage, which communicates with the pressurization chamber, and a movable part movable to abut onto and to separate from the valve body to cause the valve body to open and close the fuel suction passage to adjust a fuel amount fed into the pressurization chamber on de-energization and energization of the electromagnetic part, the control device comprising:

a plurality of sound reducing parts that is operated individually, in one open-and-close period in which the valve body opens and closes the fuel suction passage, and that reduces the operating sound, at each of the plurality of the timings, by increasing a required period of energizing the electromagnetic part relative to that in a normal control time;

an upper limit determination part that determines whether the required period of energization of the electromagnetic part in the one open-and-close period exceeds an upper limit value, when all the plurality of the sound reducing parts are operated; and a selectively operating part configured to operate the plurality of the sound reducing parts in the one open-and-close period, wherein:

the selectively operating part:

selects at least one of the plurality of the sound reducing parts according to an order of priority determined in advance on the basis of at least one of an effect of reducing the operating sound or an effect of reducing an energizing period of the electromagnetic part and operates the at least one of the plurality of the sound reducing parts, prohibits the remaining one or more of the plurality of the sound reducing parts to an extent that the required period of energizing does not exceed the upper limit value, when the upper limit determination part has determined that the required period of energizing exceeds the upper limit value, operates all of the plurality of the sound reducing parts on determination of the upper limit determination part that the required period of energizing is equal to or less than the upper limit value, and prohibits all of the plurality of the sound reducing parts in the normal control time.

24. The control device for a high pressure pump according to claim 23, wherein the plurality of the sound reducing parts includes a first sound reducing part that sets a voltage duty cycle of the electromagnetic part lower than that of the normal control time in a period after a bottom dead center of the plunger and before a top dead center of the plunger, a second sound reducing part that stops energization of the electromagnetic part at a timing which is after the top dead center of the plunger and is later than that in the normal control time, and a third sound reducing part that temporarily re-energizes the electromagnetic part after the stoppage of energizing of the electromagnetic part and before the valve body stops at a valve-opening position.

25. The control device for a high pressure pump according to claim 23, further comprising:

a part that is operated in the normal control time at each of the plurality of timings when the operating sound is generated not to reduce the operating sound.

26. The control device for a high pressure pump according to claim 23, wherein the plurality of the sound reducing parts include a valve-closing-time sound reducing part that reduces the operating sound produced when the valve body closes the fuel suction passage, and a valve-opening-time sound reducing part that reduces the operating sound produced when the valve body opens the fuel suction passage.

27. The control device for a high pressure pump according to claim 23, wherein the selectively operating part selects the at least one of the plurality of the sound reducing parts according to the order of priority determined in advance on the basis of the effect of reducing the operating sound, and operates the selected at least one of the plurality of the sound reducing parts.

28. A control device for a high pressure pump, the high pressure pump including a plunger that reciprocates with rotation of a rotating shaft so that a capacity of a pressurization chamber is variable, and a regulating valve having a valve body placed in a fuel suction passage communicating with the pressurization chamber, the regulating valve configured to close the fuel suction passage supplying fuel to the pressurization chamber when an electromagnetic actuator is in an energized state and configured to open the fuel suction passage shutting off fuel supply to the pressurization chamber when the electromagnetic actuator is in a non-energized state, as a result of moving the valve body by switching the electromagnetic actuator between the energized state and the non-energized state, and the regulating valve is further configured to adjust a fuel discharge amount of the high pressure pump by switching the regulating valve between an open state and a closed state, the control device comprising:

a non-transitory computer readable medium storing computer-readable instructions; and at least one computer hardware processor configured to execute the instructions to at least perform:

a plurality of sound reduction operations that are operated individually, when a predetermined condition for operation of the control device in a sound reducing control mode is met, at each of a plurality of timings when an operating sound is generated as a result of a movement of the valve body, in one open-and-close period in which the valve body makes an opening movement and a closing movement, and that are each configured to reduce an operating sound that is generated as a result of a movement of the valve body, at each of the plurality of the timings, by-increasing a required period of energizing the electromagnetic actuator relative to that in a normal control time;

an upper limit determination that determines whether the increased required period of energizing the electromagnetic actuator in the one open-and-close period exceeds a predetermined upper limit value, when all the plurality of the sound reduction operations are operated; and a selective operation that operates the plurality of the sound reducing operations in the one open-and-close period, wherein the selective operation selects at least one of the plurality of the sound reducing operations according to an order of priority determined in advance on the basis of at least one of an effect of reducing the operating sound or an effect of reducing an energizing period of the electromagnetic actuator and operates the at least one of the plurality of the sound reduction operations and prohibits the remaining one or more of the plurality of the sound reduction operations to an extent that the required period of energizing does not exceed the upper limit value, when the upper limit determination has determined that the required period of energizing exceeds the upper limit value.

29. The control device for a high pressure pump according to claim 28, wherein the plurality of the sound reduction operation includes:

a first sound reduction operation that sets energization of the electromagnetic actuator lower than that of the normal control time in a period after a bottom dead center of the plunger and before a top dead center of the plunger, a second sound reduction operation that stops energization of the electromagnetic actuator at a timing which is after the top dead center of the plunger and is later than that in the normal control time, and a third sound reduction operation that temporarily re-energizes the electromagnetic actuator after the stoppage of energizing of the electromagnetic actuator and before the valve body stops at a valve-opening position.

* * * * *